US005855180A

United States Patent [19]

Masters

[11] Patent Number: 5,855,180

[45] Date of Patent: Jan. 5, 1999

[54] TILTING DRY DOCK FOR SMALL WATERCRAFT

[75] Inventor: William E. Masters, Easley, S.C.

[73] Assignee: Cello-Foam NA, Inc., Conyers, Ga.

[21] Appl. No.: 850,842

[22] Filed: May 2, 1997

[51] Int. Cl.[6] ..... B63B 35/44

[52] U.S. Cl. ..... 114/263; 114/259

[58] Field of Search ..... 114/44, 45, 263, 114/259, 258, 48; 405/3

[56] References Cited

U.S. PATENT DOCUMENTS

| | | | |
|---|---|---|---|
| 3,224,019 | 12/1965 | Gudmundson | 114/45 |
| 3,406,649 | 10/1968 | Burkhart | 114/45 |
| 3,603,276 | 9/1971 | De Lisle | 114/45 |
| 3,895,592 | 7/1975 | King | 114/45 |
| 5,184,913 | 2/1993 | Meriwether | 114/48 |
| 5,641,242 | 6/1997 | Riviere | 114/263 |

*Primary Examiner*—Sherman Basinger
*Attorney, Agent, or Firm*—Cort Flint

[57] ABSTRACT

A dry dock upon which a small watercraft may be docked in a dry condition and from which a boater may access from an associated structure for launching the watercraft without entering the water is disclosed. The dry dock comprises a floating dock having a forward end and a rear entry end. A motion mechanism connects the floating dock to the pier. The motion mechanism includes a mechanical pivot carried by the floating dock by which the floating dock is connected to the associated structure. The floating dock pivots about the pivot during docking and launching of the watercraft in a seesaw motion. A buoyant fulcrum is included in the floating dock which provides buoyancy and assists the seesaw motion of the floating dock during docking of the watercraft. The dry dock seesaws between an entry position in which the floating dock is tilted rearwardly for receiving a bow section of the watercraft to initiate docking and a docked position in which the watercraft is moved forward on the floating dock and the floating dock tilted forwardly from the entry position. The motion mechanism includes a connecting link pivotly connecting the floating dock and the pier which moves in a vertical motion. A limit element limits the range of the vertical motion of the connecting link as the floating dock seesaws.

31 Claims, 2 Drawing Sheets

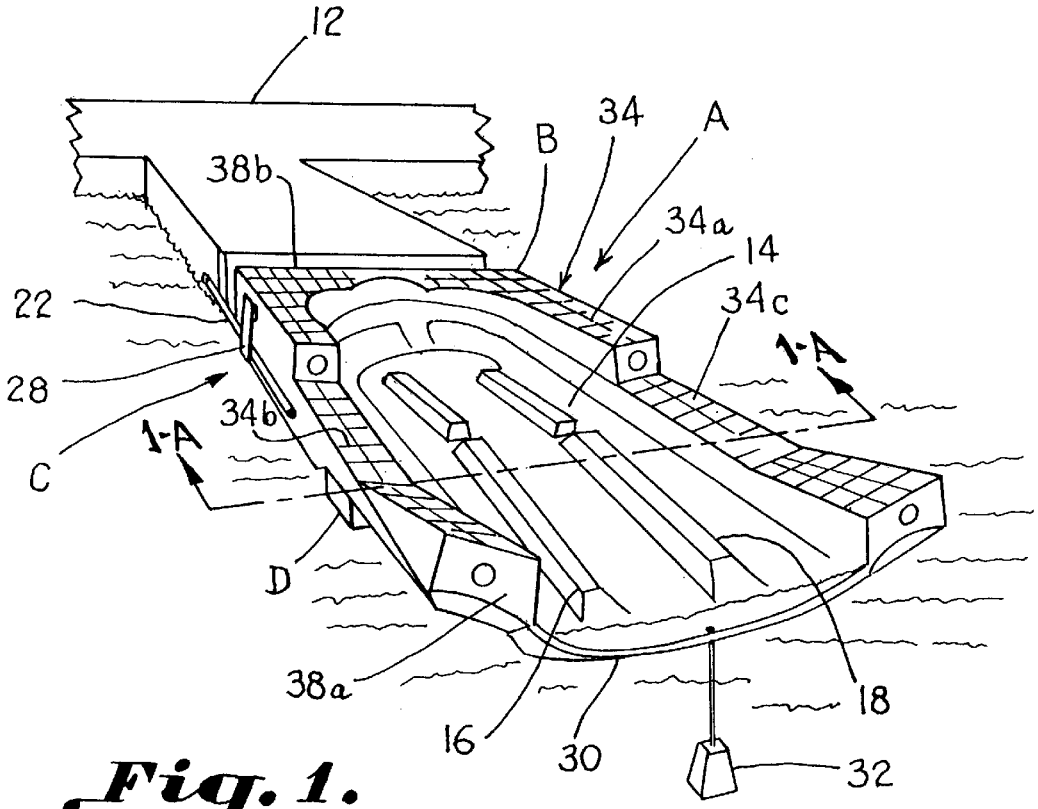
Fig. 1.
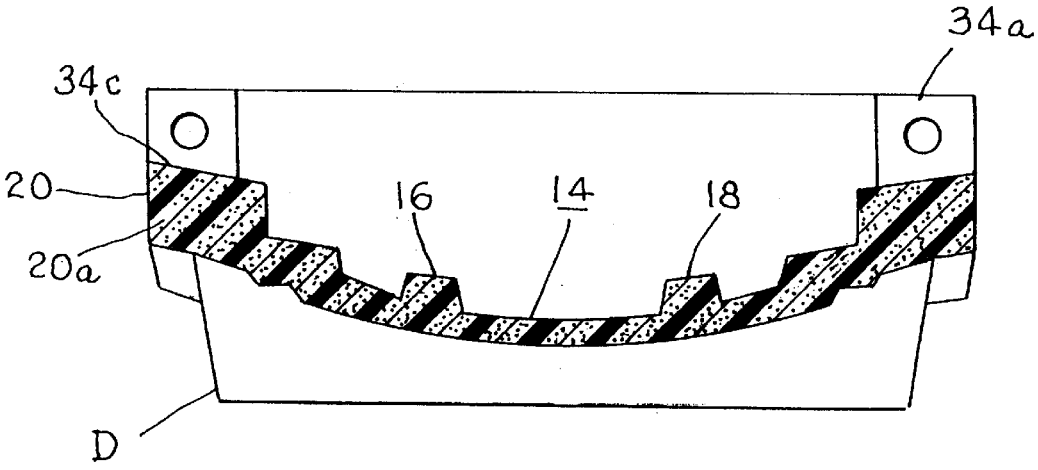
Fig. 1-A.

Fig. 4.
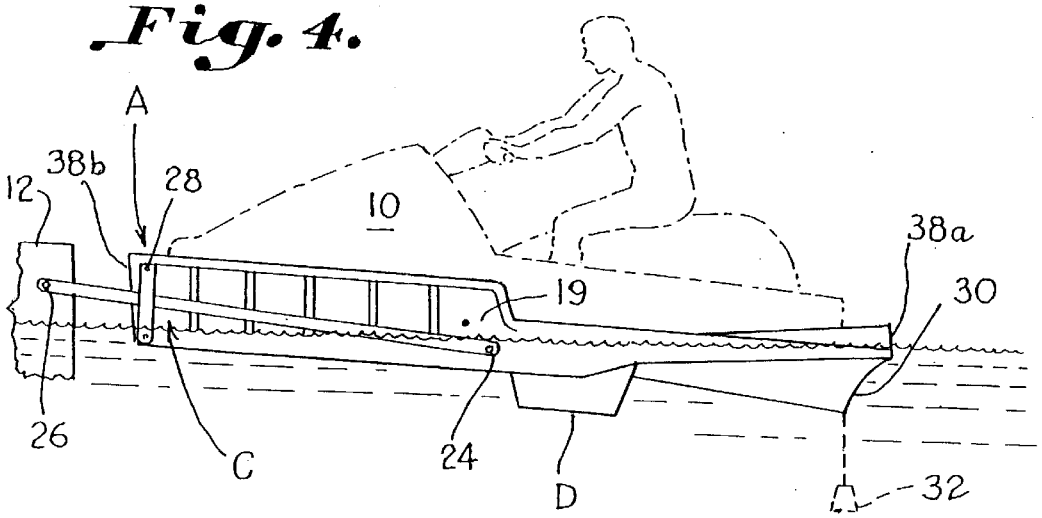
Fig. 3.
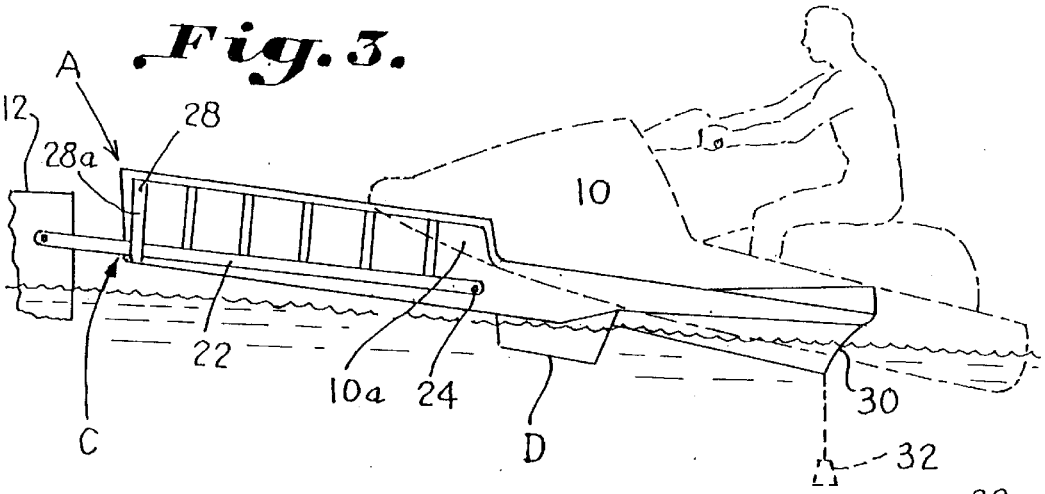
Fig. 3-A.
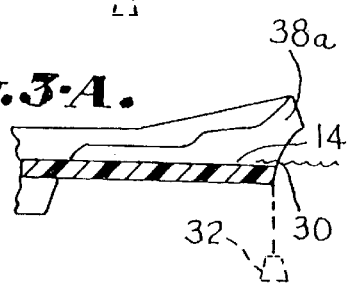
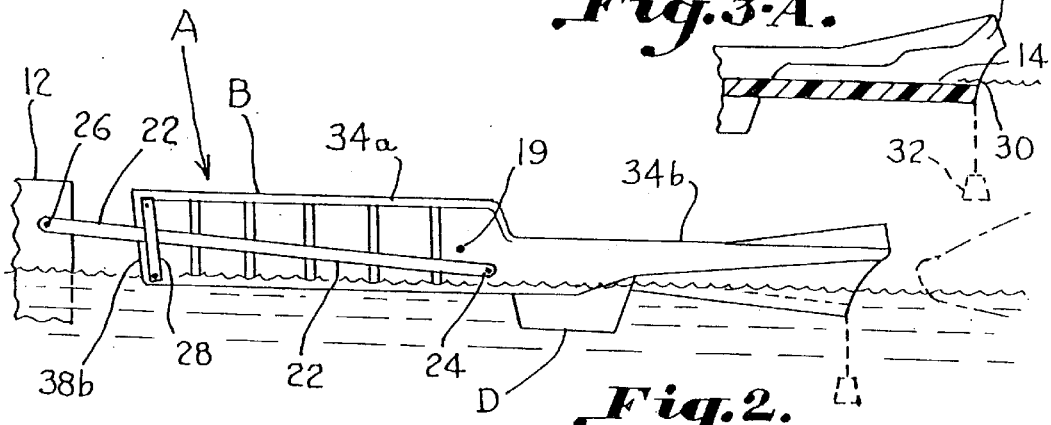
Fig. 2.

TILTING DRY DOCK FOR SMALL WATERCRAFT

BACKGROUND OF THE INVENTION

This invention relates to a dock for a small watercraft, such as a jet ski and the like, and more particularly to a dry dock which tilts in a seesaw motion as the watercraft is docked and launched from so that the boater may have ingress and egress to the watercraft generally in a dry condition.

Previously, drive on dry docks have been provided, such as shown in U.S. Pat. No. 5,529,013, wherein a dock is assembled from hollow floatation units which include tall and short units whose top surfaces are substantially co-planer. The units are arranged to form two spaced dock arms, and the short units are able to flex downward as a watercraft begins to ride upon the dock because of the location of the connection between the adjacent units. Since the tall units cannot flex to the same extent as the short units, they form a relatively stable planar surface. The short units are proportioned so that the uppermost surface of each is out of the water both when the dock is empty and when a watercraft is docked on the dock. While this assembly allows a watercraft to be driven upon the dock, it requires a large number of interconnections of floatation units which must be assembled and maintained. Another drive on dock is disclosed in U.S. Pat No. 5,281,055, wherein a dock is comprised of uniform floating docking sections coupled together with male and female connectors and anchoring rods. The docking sections can be arranged in a variety of dock designs. It has also been known to combine with such docking sections, a floating platform upon which a jet ski can be driven on and off of using a roller. The docking platform includes a contoured bottom portion which accommodates the hull of the jet ski. Considerable propulsion or effort is needed to propel the water ski over the roller to a fully docked position, and to launch the watercraft.

Accordingly, an object of the present invention is to provide an improved dry dock for a small watercraft, such as a jet ski and the like, wherein the watercraft may be dry docked and launched in a quick and easy manner.

Another object of the present invention is to provide a dry dock for a small watercraft, such as jet ski and the like, which tilts in a seesaw motion so that a minimum of propulsion or effort is needed to move the watercraft onto and off of the dry dock.

Yet another object of the present invention is to provide a dry dock for a small watercraft, such as a jet ski and the like, which is of a single unit construction so that the maintenance of a large number of interconnections is not needed.

Still another important object of the present invention is to provide a dry dock for a watercraft which is of a single unit construction and tilts about a buoyant fulcrum so that the watercraft or jet ski may be easily driven upon and moved off of the dry dock by the boater in a dry condition.

SUMMARY OF THE INVENTION

The above objectives are accomplished according to the present invention by providing a dry dock upon which a small watercraft may be docked and launched in a dry condition and from which a boater may access the watercraft from an associated pier. The dry dock comprises a floating dock having a forward end and a rear entry end. A motion mechanism connects the floating dock to the pier which provides a mechanical pivot and limit for the floating dock during docking and launching of the watercraft. A buoyant fulcrum is included in the floating dock which assists in a seesaw motion of the floating dock during docking and launching. The floating dock has an entry position in the water relative to the motion mechanism in which the floating dock is tilted rearwardly and the rear entry end of the floating dock has a displaced position in the water for receiving a bow section of the watercraft to initiate docking. Preferably, a counterweight associated with the floating dock tilts the dock to the entry position. The floating dock has at least a first intermediate position relative to the motion mechanism in which the bow of the watercraft is partially docked upon on the floating dock and may be moved forward upon the floating dock either by a manual force or a propulsion force of the watercraft. The floating dock has a docked position in which the watercraft has moved forward on the floating dock and is fully docked upon the floating dock with the floating dock tilted forwardly from the entry position and the rear entry end is raised relative to the displaced position in the water.

Advantageously, the motion mechanism includes a mechanical pivot carried by the floating dock by which the floating dock is connected to the associated pier. The floating dock tilts about the pivot and seesaws about the buoyant fulcrum when moving from the entry position to the docked position. The dry dock and motion mechanism are tilted downwardly with respect to the docked position when the floating dock and motion mechanism are in the entry position. The dry dock has another intermediate position in which the weight of the dry dock and watercraft are forward of the buoyant fulcrum causing the dry dock and watercraft to seesaw about the buoyant fulcrum counterclockwise so that the watercraft is lifted out of the water assisted by the buoyant fulcrum. The buoyant fulcrum is displaced rearward of the pivot to provide the expedient of an over the center buoyant fulcrum effect during the seesaw motion wherein the buoyancy particularly assists in tilting to the dock and watercraft to the docked position.

Advantageously, the buoyant fulcrum includes a floatation element carried laterally underneath the floating dock and displaced toward the rear end of the floating dock relative to a center line of the floating dock. The motion mechanism includes a connecting link pivotly connecting the floating dock and the pier which moves in a vertical motion, and a limit element limiting the range of the vertical motion of the connecting link as the floating dock moves relative to the pier. The limiting element comprises a vertical slot in which the connecting link moves vertically. The vertical slot is defined by a brace generally vertically arranged and affixed to the dry dock.

Advantageously, the floating dock comprises a contoured interior portion for accommodating a shape of the hull of the watercraft. The contoured portion is concave and includes a plurality of support ribs for generally maintaining the watercraft in an upright configuration for ingress and egress by the boater.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 is a prospective view of a tilting dry dock for watercraft constructed according to the present invention;

FIG. 1-A is a sectional view taken long line 1A—1A of FIG. 1;

FIG. 2 is a side elevation illustrating the tilting dry dock in a normal floating position in which it floats freely in the water without counterweight;

FIG. 3 is a side elevation of a tilting dry dock according to the invention where the watercraft is moved upon the rear end of the dry dock in an intermediate entry position tilted downwardly into the water so that the watercraft may be propelled onto the dry dock with a minimum amount of propulsion in a safe and reliable manner;

FIG. 3-A is a partially cut-away, sectional view of the rear edge of the floating dock in the entry position; and FIG. 4 is a side elevation illustrating the completion of the docking maneuver wherein the watercraft is located entirely upon the dry dock with the dry dock pivoted to a normal docked position.

DESCRIPTION OF A PREFERRED EMBODIMENT

Referring now in more detail to the drawings, a tilting dry dock is illustrated generally at A for a small watercraft such as a jet ski 10 and the like. The tilting dry dock includes a floating dock B and a motion mechanism C which attaches the floating dock to an associated fixed pier 12.

As can best be seen in FIGS. 1 and 1-A, floating dock B includes an interior contoured portion 14 having a pair of raised ribs 16 and 18 for engaging and supporting the underneath portion of the hull of jet ski 10 to support and maintain the jet ski and/or watercraft in an upright position for dock launching and docking of the watercraft. The design of the contoured portion 14 is also important to the tilting of the dock during docking and launching of the watercraft in a dry condition as will be explained more fully below. Floating dock B further includes a buoyant fulcrum D which is advantageously positioned to the rear of a center line 19 of the dry dock in the illustrated embodiment. Center line 19 preferably corresponds to the balance point of the floating dock with the jet ski in a docked position. Location of the fulcrum element D to the rear of the center line enables over center rotation of the dry dock as the watercraft enters upon the dry dock to facilitate completion of the docking maneuver. Fulcrum element D also adds additional floatation when the dry dock has a watercraft on it. Fulcrum element D may be a solid body across the width, or a plurality of buoyant elements spaced across the width. The pivoting or seesaw action of the tilting dry dock about fulcrum D to allow dry docking will also be described in more detail and become apparent below. In some applications, the mechanical pivot point and the buoyancy pivot may be located over each other rather than displaced.

The dry dock may be constructed from any suitable plastic or metal material. Preferably, as can best be seen in FIG. 1-A, floating dry dock B is constructed as a one piece hollow body molded from a suitable plastic such as a medium density polyethylene material 20 filled with an expanded polystyrene foam illustrated in cross-section at 20*a*, or other suitable floatation. The one piece construction may be molded by any suitable molding technique, such as injection molding, rotational molding, composite, thermoform molding, or blow molding.

Motion mechanism C includes a connecting link 22 pivotally connected at 24 to the dry dock and pivotally connected at 26 to pier 12. A vertical brace 28 is connected to the dry dock defining a slot between the brace and the dry dock in which connecting link 22 is permitted limited vertical movement as the dry dock tilts and is lowered and raised relative to the water. When the dry dock is empty, a rear entry end of the floating dock 38*a* sits just below the water level by pivoting about fulcrum element D under the weight of a counterweight element shown at 32. Weight element 32 may be a cement block, or other suitable weight affixed to the tilting dry dock. Remaining portions of the dry dock are intended to provide a stable platform as the boater enters or leaves into or onto the watercraft during boating. For this purpose, a generally level platform 34*a* is provided at the front portion of the dry dock with side platforms 34*b* and 34*c* providing for a walking platform for the boater as he is using the boat or jet ski.

Motion mechanism C includes pivot 24 associated with the floating dock B which provides a mechanical pivot about which the floating dock tilts in a seesaw motion during docking and launching. Fulcrum D provides a buoyancy fulcrum. The floating dock has an normal position (FIG. 2) in the water in which the floating dock is tilted partially rearwardly about the pivot. Lower edge 30 of rear entry end 38*a* of the floating dock has a displaced position in the water in an entry position for receiving a bow section of the watercraft to initiate docking (FIGS. 3, 3A). Floating dock A has a docked position (FIG. 4) in which the watercraft is moved forward on the floating dock past the pivot (e.g. 24 and/or D), and the watercraft is fully docked upon the floating dock. The floating dock is tilted forwardly about the pivot from the entry position so that the rear entry end is raised relative to the displaced position in the water. The dry dock has at a number of intermediate positions relative to the motion mechanism as the watercraft is moved forward upon the floating dock either by a manual force or a propulsion force whereby the floating dock seesaws forward to the docked position as a center of gravity of the watercraft passes over the pivot.

In operation, when the dry dock is empty, lower 30 sits below the water level. As the jet ski or watercraft is driven to rest on the rear edge 30 of the entry end in the center of the dry dock, the weight of the boat pushes the rear end deeper into the water causing the front 38*b* of the dry dock to rise out of the water until stopped by brace 28 coming into contact with the connecting link 22. Once the bow of the watercraft has submerged the entry end 30 of floating dock B, the boat operator uses the boat's propulsion to drive the watercraft onto the dry dock or manually pulls or winches the watercraft onto the dock. When the weight of the watercraft centers on the dock, the weight of the dry dock and the boat will be forward of the fulcrum D causing the dry dock and watercraft to pivot forward thereby raising the boat out of the water. When the operator wishes to return the watercraft to the water, the operator walks on the platform 34*b* out past the fulcrum D to the rear of the dry dock. The operator's weight will counterbalance the dry dock causing it to pivot on the about the fulcrum D placing the rear of the boat in the water in a floating condition. The operator then tugs the front of the watercraft off the dry dock until the boat is floating free. The operator then boards the watercraft and drives away. The dock remains tilted with rear edge 30 just under the water for dry docking of the watercraft on return.

While a preferred embodiment of the invention has been described using specific terms, such description is for illustrative purposes only, and it is to be understood that changes and variations may be made without departing from the spirit or scope of the following claims.

What is claimed is:

1. A dry dock upon which a small watercraft may be docked and launched in a dry condition and which a boater may access from an associated structure, said dry dock comprising:

a floating dock having a forward end and a rear entry end;

a motion mechanism connecting said floating dock to said associated structure as said floating dock moves in a seesaw motion during docking and launching;

a buoyant fulcrum included underneath said floating dock providing buoyancy to said dock as said dock seesaws in the water;

said floating dock having an entry position in the water relative to said motion mechanism in which said floating dock is tilted rearwardly and said rear entry end of said floating dock has a displaced position in the water for receiving a bow section of said watercraft to initiate docking;

said floating dock having intermediate positions relative to said motion mechanism as the watercraft is moved forward upon said floating dock and over said buoyant fulcrum either by a manual force or a propulsion force of the watercraft; and said floating dock having a docked position in which said watercraft is moved forward on said floating dock and is fully docked upon said floating dock with said floating dock tilted forwardly from said entry position and said rear entry end is raised relative to said displaced position in the water.

2. The dry dock of claim 1 wherein said motion mechanism includes a mechanical pivot carried by said floating dock by which said floating dock is connected to the associated pier.

3. The dry dock of claim 2 wherein said floating dock tilts about said pivot and buoyant fulcrum when seesawing from said entry position to said docked position.

4. The dry dock of claim 2 wherein said buoyant fulcrum is displaced rearward of said pivot.

5. The dry dock of claim 1 wherein said dry dock has an intermediate position in which the weight of said dry dock and watercraft are forward of said buoyant fulcrum causing said dry dock and watercraft to move about said buoyant fulcrum counterclockwise so that the watercraft is lifted out of the water assisted by said buoyant fulcrum.

6. The dry dock of claim 1 wherein said buoyant fulcrum includes at least one floatation element carried underneath said floating dock.

7. The dry dock of claim 6 wherein said buoyant fulcrum is displaced toward the rear end of said floating dock relative to a center line of said floating dock.

8. The dry dock of claim 1 wherein said motion mechanism includes a connecting link pivotly connecting said floating dock and said associated structure which moves in a vertical motion, and a limit element limiting the range of the vertical motion of said connecting link as said floating dock moves relative to said associated structure.

9. The dry dock of claim 8 wherein said limiting element comprises a vertical slot in which said connecting link moves vertically.

10. The dry dock of claim 9 wherein said vertical slot is defined by a brace generally vertically arranged and affixed to one of said dry dock and associated structure.

11. The dry dock of claim 10 wherein said brace is affixed to said floating dock.

12. The dry dock of claim 1 wherein said floating dock comprises a contoured interior portion for accommodating a shape of the hull of said watercraft.

13. The dry dock of claim 12 wherein said contoured portion is concave and includes a plurality of support ribs for generally maintaining said watercraft in an upright configuration for ingress and egress by said boater.

14. The dry dock of claim 12 wherein said floating dock includes a walking platform on opposing sides of said contoured interior portion.

15. The dry dock of claim 1 wherein said buoyant fulcrum is displaced toward the rear end of said floating dock relative to a center line of said floating dock.

16. The dry dock of claim 1 including a counterweight associated with said floating dock to tilt said dock to said entry position.

17. A dry dock upon which a small watercraft may be docked in a dry condition and from which a boater may access from an associated structure for launching the watercraft without entering the water, said dry dock comprising:

a floating dock having a forward end and a rear entry end;

a motion mechanism connecting said floating dock to said associated structure, said motion mechanism including a first mechanical pivot associated with said floating dock about which said floating dock tilts in a seesaw motion during docking and a second mechanism pivot associated with said associated structure; said floating dock having an entry position in the water in which said floating dock is tilted rearwardly about said first pivot, and said rear entry end of said floating dock has a displaced position in the water in said entry position for receiving a bow section of said watercraft to initiate docking; and said floating dock having a docked position in which said watercraft is moved forward on said floating dock past said pivot and said watercraft is fully docked upon said floating dock, and said floating dock being tilted forwardly about said pivot from said entry position to said docked position so that said rear entry end is raised relative to said displaced position in the water.

18. The dry dock of claim 17 wherein said floating dock has at least a first intermediate position relative to said motion mechanism as said watercraft is moved forward upon said floating dock either by a manual force or a propulsion force of the watercraft so that said floating dock seesaws forward as a center of gravity of said water craft passes over said pivot.

19. The dry dock of claim 17 wherein said motion mechanism includes a connecting link connecting said floating dock to said associated structure, and said connecting link having an end connected to said pivot associated with said floating dock, and a limit which limits the vertical movement of said connecting link.

20. The dry dock of claim 17 wherein said floating dock includes a buoyant fulcrum carried below a water line of said floating dock.

21. The dry dock of claim 20 wherein said buoyant fulcrum is displaced relative to said mechanical pivot.

22. The dry dock of claim 17 including a buoyant fulcrum included in said floating dock.

23. The dry dock of claim 22 wherein said buoyant fulcrum is displaced toward the rear end of said floating dock relative to a center of said floating dock.

24. A dry dock upon which a small watercraft may be docked in a dry condition and from which a boater may access from an associated pier for launching the watercraft without entering the water, said dry dock comprising:

a floating dock having a forward end and a rear end;

a motion mechanism connecting said floating dock to said pier;

said motion mechanism includes a mechanical pivot carried by said floating dock by which said floating dock is connected to the associated pier; and said floating dock pivots about said pivot during docking and launching of said watercraft in a seesaw motion;

a buoyant fulcrum included underneath said floating dock which provides buoyancy to said floating dock and assists the seesaw motion of said floating dock during docking of said watercraft as said watercraft moves onto said dock and over said buoyant fulcrum.

25. The dry dock of claim 24 wherein said floating dock seesaws between an entry position in which said floating dock is tilted rearwardly for receiving a bow section of said watercraft to initiate docking and a docked position in which said watercraft is moved forward on said floating dock and said floating dock tilted forwardly from said entry position.

26. The dry dock of claim 24 wherein said buoyant fulcrum is displaced relative to said mechanical pivot.

27. The dry dock of claim 24 wherein said buoyant fulcrum includes a floatation element carried below a water line of said floating dock.

28. The dry dock of claim 27 wherein said buoyant fulcrum is displaced toward the rear end of said floating dock relative to a center line of said floating dock.

29. The dry dock of claim 24 wherein said motion mechanism includes a connecting link pivotly connecting said floating dock and said pier which moves in a vertical motion, and a limit element limiting the range of the vertical motion of said connecting link as said floating dock moves relative to said pier.

30. The dry dock of claim 24 wherein said floating dock comprises a contoured interior portion for accommodating a shape of the hull of said watercraft, and said contoured portion is concave and includes a plurality of support ribs for generally maintaining said watercraft in an upright configuration for ingress and egress by said boater.

31. The dry dock of claim 24 including a counterweight for tilting said floating dock to an entry position for receiving said watercraft for dry docking.

* * * * *